US006101855A

United States Patent [19]

Dimig et al.

[11] Patent Number: 6,101,855

[45] Date of Patent: Aug. 15, 2000

[54] KEY AND CYLINDER LOCK SYSTEM

[75] Inventors: Steven J. Dimig, Plymouth; Keith D. Zirtzlaff, Port Washington, both of Wis.

[73] Assignee: Strattec Security Corporation, Milwaukee, Wis.

[21] Appl. No.: 09/149,469

[22] Filed: Sep. 8, 1998

[51] Int. Cl.[7] ..... E05B 19/06

[52] U.S. Cl. ..... 70/406; 70/407; 70/409; 70/492

[58] Field of Search ..... 70/409, 492, 402, 70/405–407

[56] References Cited

U.S. PATENT DOCUMENTS

| | | | |
|---|---|---|---|
| 1,204,410 | 11/1916 | Christoph | 70/492 |
| 1,384,179 | 7/1921 | Christoph | 70/492 |
| 1,406,574 | 2/1922 | Mantanfel | 70/492 |
| 1,444,429 | 2/1923 | Rogginger | 70/492 |
| 1,550,379 | 8/1925 | Manteufel | 70/492 |
| 1,556,606 | 10/1925 | Jacobi et al. | 70/492 |
| 1,644,092 | 10/1927 | Shinn | 70/492 |
| 1,725,557 | 8/1929 | Baird | 70/492 |
| 1,996,811 | 4/1935 | Jacobi | 70/406 |
| 2,035,181 | 3/1936 | Molinare | 70/409 |
| 2,039,126 | 4/1936 | Svoboda | 70/492 X |
| 2,155,440 | 4/1939 | Olson | 70/492 X |
| 2,647,391 | 8/1953 | Uher | 70/492 X |
| 2,970,466 | 2/1961 | Wellekens | 70/492 X |
| 3,427,833 | 2/1969 | Lempke | 70/408 |
| 3,707,863 | 1/1973 | Schwab et al. | 70/377 X |
| 3,861,181 | 1/1975 | Needham et al. | 70/409 X |
| 4,168,617 | 9/1979 | Prunbauer | 70/406 |
| 4,270,372 | 6/1981 | Vonlanthen et al. | 70/406 |
| 4,356,713 | 11/1982 | Widen | 70/358 X |
| 4,357,815 | 11/1982 | Kleefeldt et al. | 70/337 |
| 4,385,510 | 5/1983 | Harper | 70/375 X |
| 4,393,673 | 7/1983 | Widen | 70/358 |
| 4,977,767 | 12/1990 | Prunbauer | 70/406 |
| 5,265,455 | 11/1993 | Grimmer | 70/492 |
| 5,520,035 | 5/1996 | Eizen et al. | 70/358 |

FOREIGN PATENT DOCUMENTS

| | | | |
|---|---|---|---|
| 593539 | 3/1934 | Germany | 70/492 |
| 259888 | 8/1928 | Italy | 70/492 |
| 23424 | 6/1910 | United Kingdom | 70/492 |
| 28286 | 8/1910 | United Kingdom | 70/492 |
| 447127 | 5/1936 | United Kingdom | 70/492 |
| 2010371 | 7/1979 | United Kingdom | 70/492 |

*Primary Examiner*—Lloyd A. Gall
*Attorney, Agent, or Firm*—Reinhart, Boerner, Van Deuren, Norris & Rieselbach, s.c.

[57] ABSTRACT

A dual cam, reversible key includes first and second patterns of notches in first and second edges of the shank of the key on a common side of the key shank of the key, providing a dual cam key. The patterns of notches are formed to have complementary symmetry and to make the width of the shank constant along at least the portion of the shank that includes the notches. The first pattern of notches is identical with the second pattern of notches insomuch as they are "parallel" to each other. The key operates tumblers each of which has an opening defining a pair of staggered generally rectangular windows, each of the windows defining cam surfaces for accommodating the dual cam, reversible key. Also disclosed is a method for making the dual cam, reversible key.

10 Claims, 5 Drawing Sheets

KEY AND CYLINDER LOCK SYSTEM

BACKGROUND OF THE INVENTION

This invention relates to lock and key sets which include reversible keys, and also to a dual cam, reversible key and to a method of making the key.

Over the years, various key configurations have been used for automotive lock applications. The traditional key configuration used for automotive applications has been the blade key. Notches are cut in an edge of the key blade for establishing the coding for the key. Other known types of blade keys have notches or grooves milled into the side of the key blade to provide the coding for the key. A further type of key, which is adapted for use with a rotary tumbler arrangement, has multiple milled surfaces formed on the end of a round shank.

In the traditional key and tumbler lock design, as the key is being inserted into or removed from the cylinder of the lock, a tumbler is cammed up in the lock when the tumbler engages an upward sloping surface of a notch in the key. However, such locks usually rely on a tumbler spring to hold the tumbler against the key when a downward sloping cam surface on the key passes by the tumbler. Problems can occur with this type of design when tumbler springs are broken, missing or malfunctioning or when the tumblers stick due to corrosion, ice or other contaminants that enter the lock. If, for any reason, the tumbler spring cannot provide sufficient force to move the tumbler, the lock becomes inoperative.

The problems associated with traditional key and tumbler designs have been alleviated to some extent by lock systems which include side-milled keys and rotary tumbler locks. The notches for side-milled keys are configured to cause the tumblers to be cammed up as well as down in the lock. Thus, lock systems employing side-milled key designs do not have to rely on a minimal force provided by a spring to return the lock tumblers to their locking position when the key is withdrawn, for example. The force available to shift the tumblers up and down is proportional to the force with which the key is inserted into or withdrawn from the lock. Consequently, the locks are much less susceptible to problems associated with tumbler sticking. Although side-milled keys and rotary tumbler locks offer improved performance over the traditional key and tumbler designs, high volume users, such as the automotive industry, have been reluctant to switch to lock systems which employ side-milled keys. This is partly because only a small percentage of lock producers, dealers and locksmiths have the capability of producing these alternate notch key designs, and some side-milled key configurations can be very costly to produce. In addition, some alternate key designs require very specialized equipment to produce and/or duplicate the keys.

A shortcoming of lock systems which include side-milled keys is that the locks typically require tumblers that have a small tab which rides in a track formed in the key shank for actuating the tumbler up and down as the key is inserted or removed. Such tabs are very vulnerable to damage and can be bent or broken off as the result of operating the lock, requiring repair or replacement of the lock.

It is, therefore, an object of the invention to provide a new and improved lock and key set.

Another object of the invention to provide a lock and key set which includes a dual cam, reversible key.

A further object of the invention to provide a dual cam, reversible key and a method of making the key.

Yet another object of the invention is to provide a dual cam, reversible key which is inexpensive to produce and which can be produced and/or duplicated using existing key manufacturing equipment.

SUMMARY OF THE INVENTION

The present invention provides a cylinder lock and key set which includes a dual cam, reversible key having patterns of notches formed in first and second edges of the key blade for coding the key. According to the invention, when viewed in a profile cross-section, the coded notched edges are located on the same side of the key, unlike known reversible keys which have the notched edges located on opposite sides of the key, staggered from one another. Furthermore, according to the invention, the patterns of notches on the edges of the key are formed to be of complementary symmetry, with the pattern of both notched edges being such that the width of the key shank is constant along the length of the shank, at least in the area that includes the notch patterns. This is in contrast to conventional reversible keys wherein the two patterns of notches are a mirror image of each other and the width of the key shank varies along the area where it is notched.

Further in accordance with the invention, there is provided a lock system including a lock having a rotatable cylinder which mounts a plurality of tumblers. The tumblers define cam surfaces which are engageable selectively by the coded edges of the key. In one embodiment, each tumbler includes a window which defines a pair of staggered generally rectangular windows therethrough. Each window defines a pair of cam surfaces. One pair of cam surfaces is engaged by the first and second patterns of notches when the key is inserted into, or removed from the lock for a first orientation of the key. The other pair of cam surfaces is engaged by the first and second patterns of notches when the key is inserted into, or removed from the lock for a second orientation of the key. Because of the complementary nature of the patterns of notches on the key shank and the offset nature of the rectangular windows which define the cam surfaces for the tumblers, the tumblers are cammed both in an upwards as well as downwards direction as the key is being inserted into and removed from the lock. The dual cam motion on the tumblers eliminates the need for individual tumbler springs. This results in higher potential forces to shift sticking tumblers because the force to move the tumblers is determined by the force with which the key is inserted into or extracted from the lock, rather than by spring bias.

One benefit of the tumbler according to the invention is its inherent strength as compared to tumblers for locksets of the type that use a track type, side-milled key design. Tumblers for such locksets require small tabs which ride in the track of the key, and which are susceptible to damage due to bending or breaking of the tabs. The tumbler according to the invention does not require small, relatively weak protrusions which mate with the key.

Preferred embodiments of the invention further provide a method for making a key. One such preferred method provides a key blank having a shank. A pair of smaller grooves can be formed in the first side of the key. The second side of the shank of the key blank is formed to have a T-shaped configuration as viewed in direction normal to the plane of the second side of the key. A first pattern of notches is formed in a first edge of the shank along at least a portion of the length of the shank. Then, a second pattern of notches is formed in a second opposite edge of the shank along at least the portion of the length of the shank. In accordance with the invention, the first and second patterns of notches are formed to provide a constant width for the key shank along the length thereof, at least in the portion of the key shank in which the first and second patterns of notches are formed.

The dual cam, reversible key according to the invention combines the best cost and manufacturing attributes of a traditional key design with the performance improvements provided by alternately notched key designs. The dual cam, reversible key can be manufactured using existing high volume production equipment and can be duplicated with common key cutting machines found at dealers, locksmiths, hardware stores, etc.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawings, wherein like reference numerals identify like elements, and wherein:

DETAILED DESCRIPTION OF THE PREFERRED EMBODIMENTS

Figure 1:
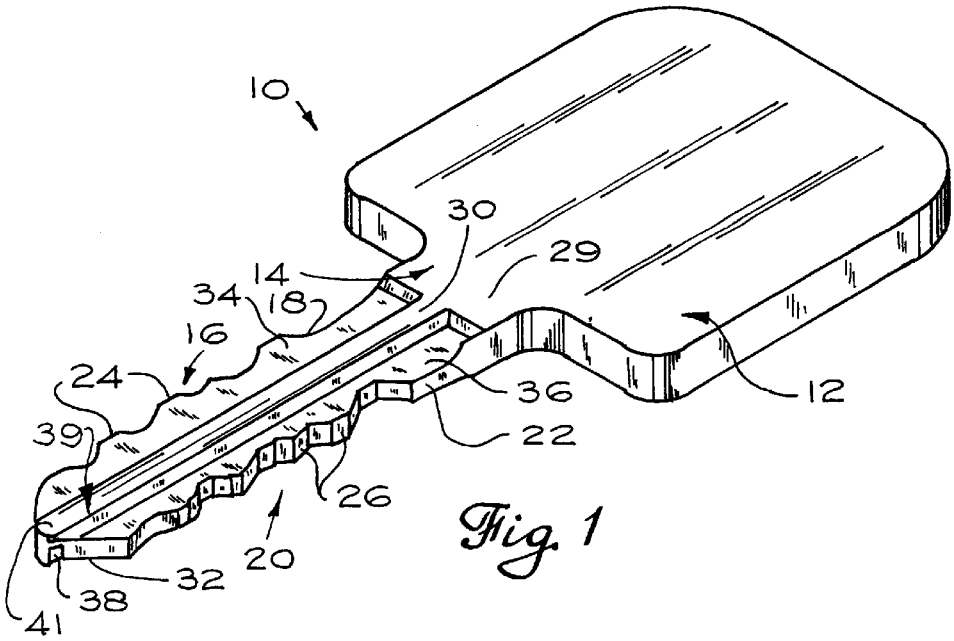
FIG. 1 is an isometric view of a dual cam, reversible key in accordance with the invention
Figure 2:
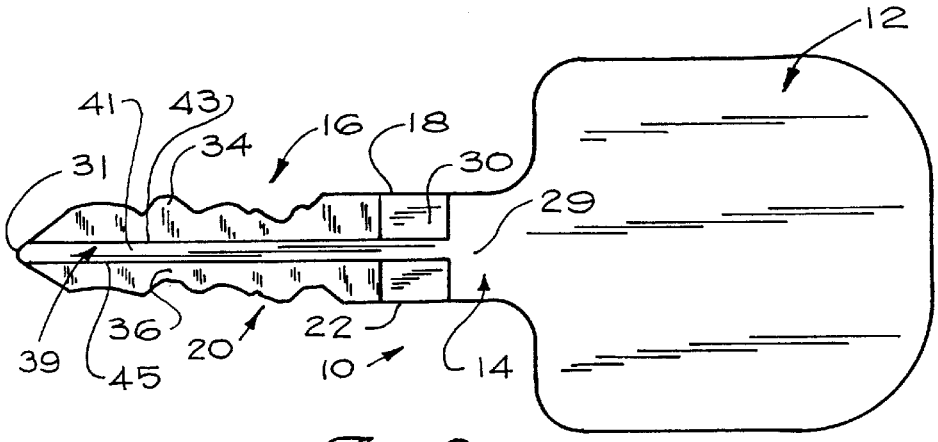
FIG. 2 is a view of one side of the key of FIG. 1.
Figure 3:
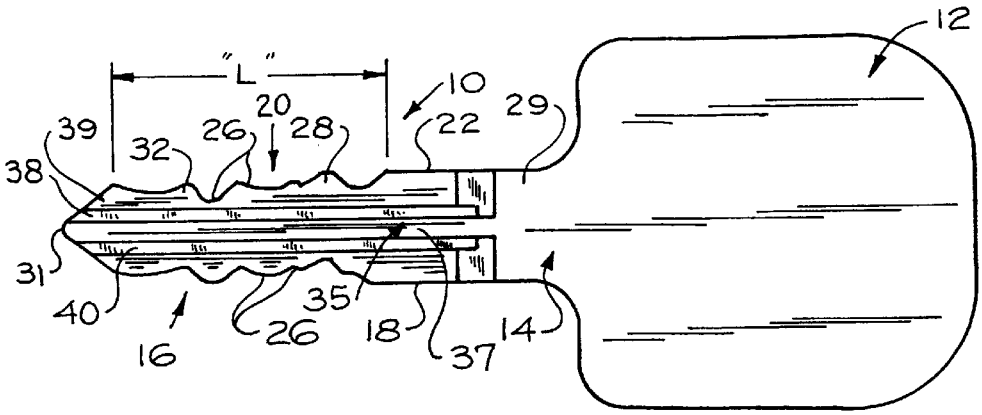
FIG. 3 is a view of the opposite side of the key of FIG. 1.

Referring to FIGS. 1–3 of the drawings, a dual cam, reversible key provided in accordance with one embodiment of the invention is indicated generally at 10. The key 10 includes a head portion 12 and a shank 14 coupled to the head portion. The shank 14 of the key has a first pattern of notches or cuts 16 formed in one edge 18 of the shank and a second pattern of notches or cuts 20 formed in the opposite edge 22 of the shank. The first and second sets or patterns of notches 16 and 18 define first and second sets of tumbler engaging surfaces 24 and 26.

One side 28 of the shank 14 includes a pair of narrow guide grooves 38 and 40 which extend in a parallel spaced relationship from a shoulder portion 29 to the tip 31 of the key, offset from the centerline of the shank defining a first projecting portion 35. The first projecting portion 35 has an outer surface 37. The opposite side 30 of the shank 14 includes shallow recesses 34 and 36 which extend inwardly from the edges 18 and 22 of the shank 14 toward the center of the shank 14. The recesses extend substantially the length of the shank 14 from the shoulder portion 29 of the shank to the tip 31 of the key defining a second projecting portion 39. The second projecting portion 39 has an outer surface 41, a first side surface 43 and a second side surface 45". The recesses 34 and 36 define a substantially T-shaped configuration or profile for the side 30 of the shank 14, as viewed in a direction normal to the plane of the side 30 of the shank.

Figure 4:
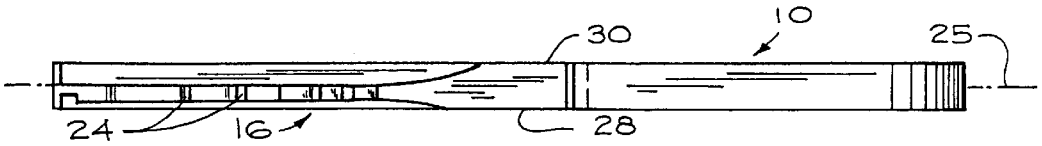
FIG. 4 is a view of one edge of the key of FIG. 1.
Figure 5:
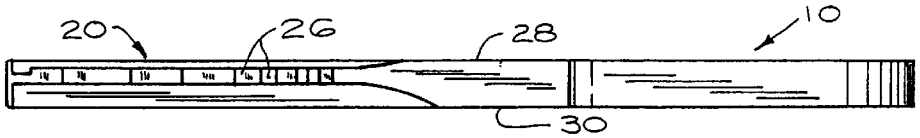
FIG. 5 is a view of the opposite edge of the key of FIG. 1.
Figure 8:
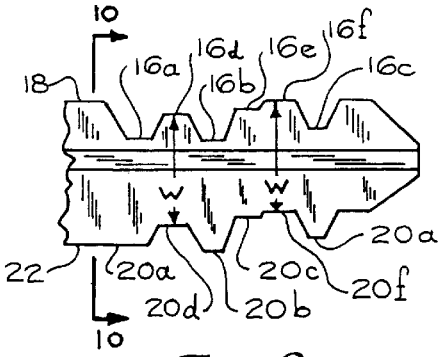
FIG. 8 is a simplified, fragmentary side view of the reversible key provided by the invention and in which the pattern of coded notches on one edge of the blade corresponds to the pattern of the coded notches on the opposite edge.

Referring also to FIGS. 4–6 and 8, in accordance with the invention, the first and second sets of tumbler engaging surfaces 24 and 26 are provided on the same side 28 of the key shank 14. That is, the patterns of notches 16 and 20 are located on one side of the vertical centerline 25 of the key as shown in FIG. 4, for example. In addition, the pattern of notches 16 formed on edge 18 of the key shank is of complementary symmetry with respect to the pattern of notches 20 formed on the opposite edge 22 of the key shank. Thus, for each of the notches 16*a*, 16*b* and 16*c*, for example, on edge 18 there are corresponding peaks 20*a*, 20*b* and 20*c* on the opposite edge 22. Conversely, for each of the peaks 16*d*, 16*e* and 16*f*, for example, on edge 18, there are corresponding notches 20*d*, 20*e* and 20*f* on the opposite edge 22. In FIG. 8, it can be seen that the separation "w" between each notch on one edge and its corresponding peak on the opposite edge, is constant so that the width "w" of the shank is constant at least over the notched portion of the shank, i.e., the shank portion containing the patterns of notches 16 and 20. While one geometry is shown for the patterns of notches, it will be understood that the pattern depends upon the coding used for the key as long as the patterns are formed to be of complementary symmetry.

Figure 7:
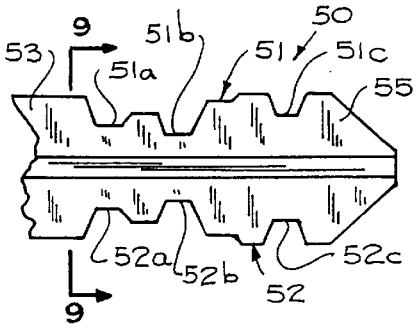
Fig. 7 Prior Art
FIG. 7 which is labeled "Prior Art ", is a simplified, fragmentary side view of a known reversible key in which the coded notches on one edge of the blade are a mirror image pattern of the coded notches on the opposite edge.
Figure 9:
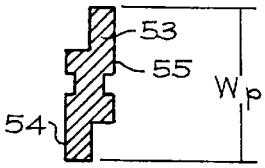
Fig. 9 Prior Art
FIG. 9 which is labeled "Prior Art ", is a vertical profile section view taken along the line 9—9 of FIG. 7.
Figure 10:
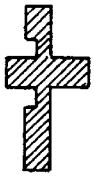
FIG. 10 is a vertical profile section view taken along the line 10—10 of FIG. 8.

With reference to FIG. 7, which is labeled "Prior Art", there is shown a simplified, fragmentary side view of a known reversible key 50. In known reversible keys, the coded notches 51*a*–51*c* and 52*a*–52*c* are located on opposite sides 53 and 54 of the key as is shown in FIG. 9. The coding of the two notch patterns, indicated generally at 51 and 52, are a mirror image of one another as shown in FIG. 7. For example, for each of the notches 51*a*, 52*b* and 52*c* on side 53, there is a corresponding notch 52*a*, 52*b* and 52*c* on side 54. Therefore, the width "$w_p$" of the shank 55 (FIG. 9) varies along the portion of the key shank containing the coded notches.

Figure 6:
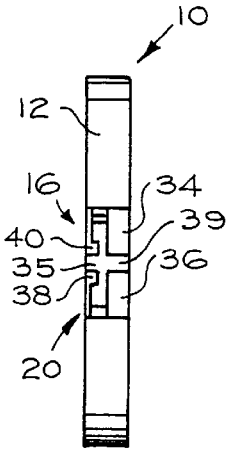
FIG. 6 is an end view of the key of FIG. 1.

Referring now to FIG. 8, there is shown a simplified, fragmentary side view of the reversible key 10 provided by the invention. In contrast to known reversible keys, such as key 50 shown in FIGS. 7 and 9, which has the notches 51*a*–51*c* and 52*a*–52*c* staggered from each other on opposite sides 53 and 54 of the key, the dual cam, reversible key 10 has a profile in which both of the coded notched edges 16 and 20 are located on the same side 28 of the key (FIG. 6). The first and second patterns of notches 16 and 20, which define the tumbler engaging surfaces 24 and 26, extend along the longitudinal axis of the key shank a length "L" (FIG. 3) between the shoulder portion 29 and the tip 31 of the shank 14. Thus, the two patterns of notches are located on the same side of a centerline 25 (FIG. 4). Furthermore, the pattern of notches 16 on one edge 18 of the key shank is formed to have a complementary symmetry with respect to the pattern of notches 20 on the opposite edge 22 of the key shank, providing a constant blade width "w" along the length "L" of the shank 14 in the area of the shank that contains the notches.

The first and second sets of notches have outer surfaces which extend in parallel relation on said first side of the shank. The width of the notches "w" is the same along the length "L" of the shank. That is, the width of the shank is constant over the extent of the area of the shank which is notched. The pattern of notches on one edge of the key shank is "parallel" to the pattern of notches on the opposite edge of the key shank, defining a constant blade width along the length of the shank at least in the area containing the patterns of notches. By "parallel" it is meant that points along the notch pattern on one edge of the shank of the key are spaced apart a fixed distance "w" from the corresponding points along the notch pattern on the opposite edge of the shank of key shank.

In one preferred embodiment, the thickness of the shank 14 of the dual cam, reversible key 10 provided by the invention can be comparable to the thickness of known reversible keys. However, the thickness of the shank of the dual cam, reversible key of the invention can be slightly greater than the thickness of known keys. The notched portion of the shank can be up to one-half the thickness of the shank.

Figure 11A:
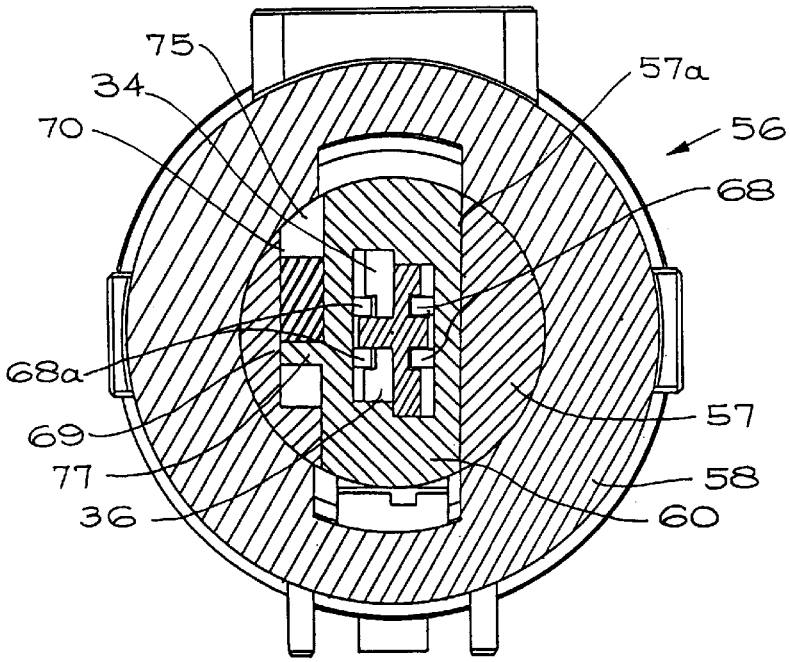
FIG. 11A is a vertical section view of a lock and key set incorporating the tumblers provided by the invention.
Figure 11B:
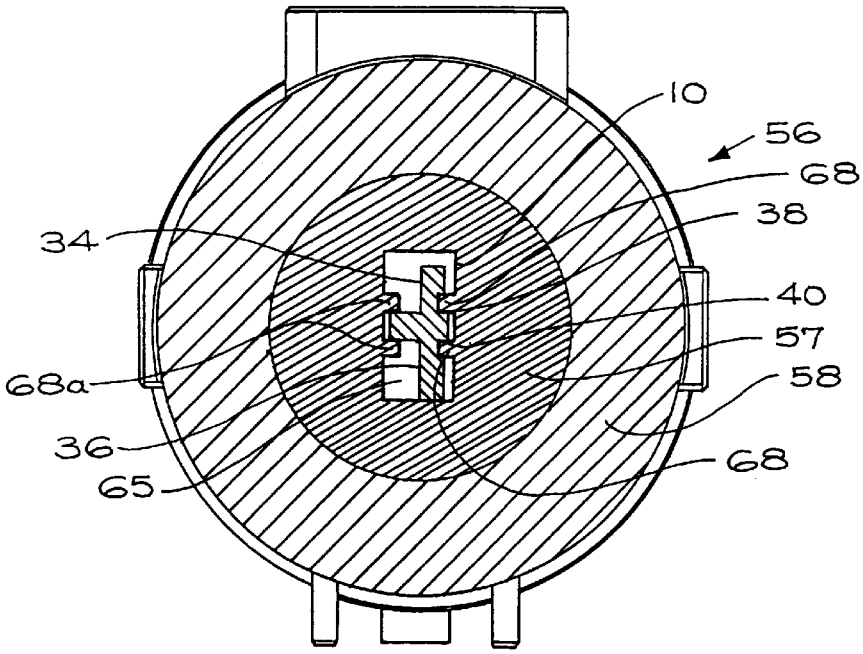
FIG. 11B is a vertical section view of a lock and key set according to the invention, and showing the guide ribs which cooperate with the guide grooves of the key.
Figure 11E:
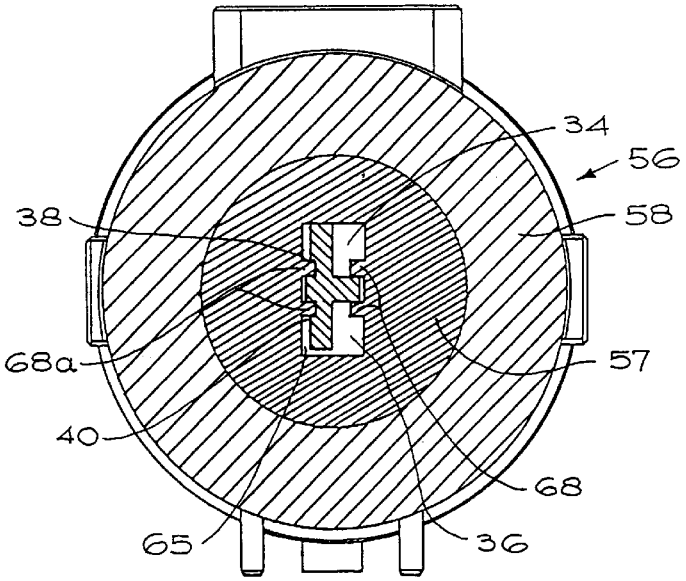
FIG. 11C is a view similar to that of FIG. 11B and showing the key reversed.

Referring to FIGS. 11A and 11B, the dual cam, reversible key 10 is particularly suitable for use with a rotatable tumbler lock 56 including lock cylinder 57 which is mounted for rotation within a case 58. The cylinder 57 is adapted to mount a plurality of plate tumblers, such as plate tumbler 60 shown in FIG. 11A, in tumbler wards 57*a* of the cylinder 57 for movement within the tumbler wards generally normal to the axis of the cylinder as the key is inserted into keyway 65 of the lock or removed from the lock. The tumbler engaging surfaces provide a dual cam function for activating tumblers both up and down, generally in the manner of some side-milled keys. Referring also to FIG. 11B, the cylinder 57 can include guide ribs 68 which cooperate with the grooves 38 and 40 and guide ribs 68*a* which connects with the recessed portions 34 and 36 of the key shank 14 to guide insertion of the reversible key 10 into the lock for one orientation of the key. FIG. 11C shows the cooperation between the guide ribs 68 and 68*a* and the grooves 38, 40 and the recessed portions 34 and 36 for the opposite orientation of key 10.

Figure 12:
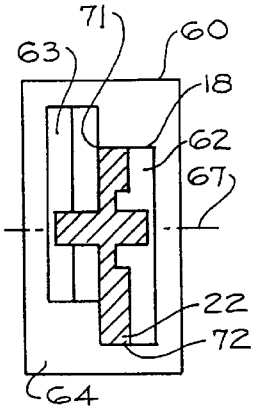
FIG. 12 is a simplified end view of a lock cylinder tumbler provided by the invention with the key provided by the invention shown positioned in the window of the tumbler in a first orientation.

Referring to FIG. 12, each of the tumblers for the lock 56, such as tumbler 60 shown in FIG. 11A, includes an opening 61 defined by a pair of staggered generally rectangular windows 62 and 63. By staggered is meant that the two windows of the pair of windows are shifted up and down, respectively, relative to the transverse axis or centerline 67 of the tumbler 60. The windows 62 and 63 are of the same size but are offset from a vertical centerline of the tumbler.

Figure 13:
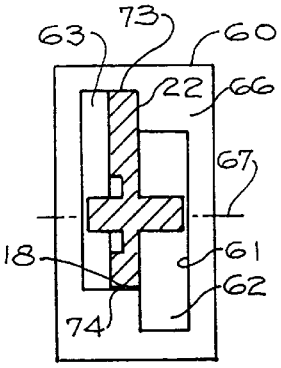
FIG. 13 is a view similar to FIG. 12 and with the key shown positioned in the window of the tumbler in a second orientation.

In contrast to conventional locks, in which the profile of the key corresponds to the profile of the keyway and/or the opening 61 through the plate tumbler 60 of the lock, the dual cam, reversible key 10 has both of its notched edges 18 and 22 disposed in window 62 at one side 64 of the tumbler as shown in FIG. 12. For the orientation of the key 10 shown in FIG. 12, the notched edges 18 and 22 contact cam surfaces 71 and 72 of the rectangular window portion 62 of the tumbler 60, respectively. When the key 10 is inserted into the lock oriented 180° C. relative to its orientation in FIG. 12, the notched edges 18 and 22 are disposed in window 63 at the opposite side 66 of the tumbler as illustrated in FIG. 13. Cam surfaces 73 and 74 of tumbler 60 are contacted by the notched edges 22 and 18, respectively, of the shank of the key as the key is being inserted into the keyway 65 of the lock 56 (FIG. 11C).

Thus, when the key is inserted into the keyway 65 with the orientation shown in FIG. 12, the notched edges 18 and 22 contact cam surfaces 71 and 72 of one (62) of the staggered window openings. When the orientation of the key is reversed as shown in FIG. 13, the notched edges 18 and 22 contact cam surfaces 74 and 73 of the opposite staggered window opening 63. The complementary patterns of notches 18 and 22 in the key 10 allow the tumblers 60 to be cammed in an upwards as well as downwards direction as the key is inserted into and extracted from the lock. The dual cam motion on the tumblers 60 eliminates the need for individual tumbler springs. In one preferred embodiment, all of the tumblers can be biased to a down (or up) position in the tumbler wards by a resilient member, such as a spring or an elastomeric element 69 (FIG. 11A) that is common to all of the tumblers. The resilient member 69 is located in a channel 70 defined by a shoulder 75 formed on the cylinder 57. The resilient member 69 causes all of the tumblers to be positioned in a down position for a key-out condition. The resilient member 69 is compressed between the shoulder 75 and a projection on the tumblers, such as projection 77 on tumbler 60, when the tumblers are lifted from their down position. In one embodiment, the resilient member 69 returns the tumblers to the down position when the key 10 is removed from the lock 56.

Figure 14:
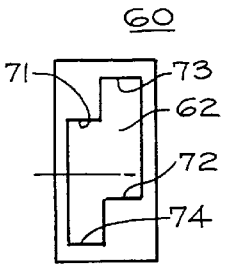
FIG. 14 is an end view of a tumbler of a lock cylinder for use with a key having a notch of a given depth.
Figure 15:
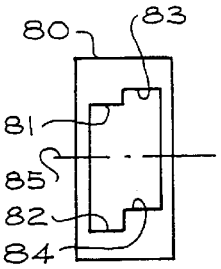
FIG. 15 is a view similar to FIG. 14 and showing the stagger of the window shifted in the tumbler to accommodate a key having a different notch depth.
Figure 16:
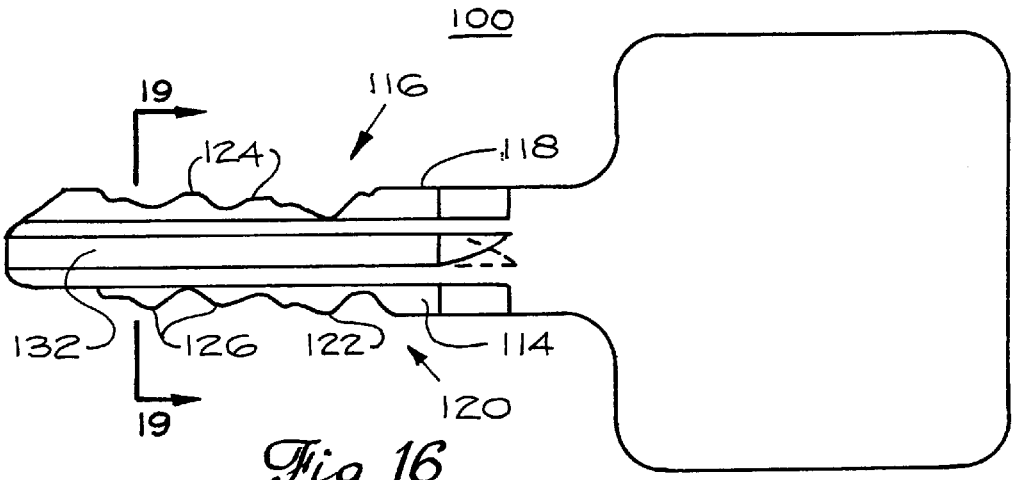
FIG. 16 is a view of one side of a dual cam, reversible key provided in accordance with further embodiment of the invention.
Figure 17:
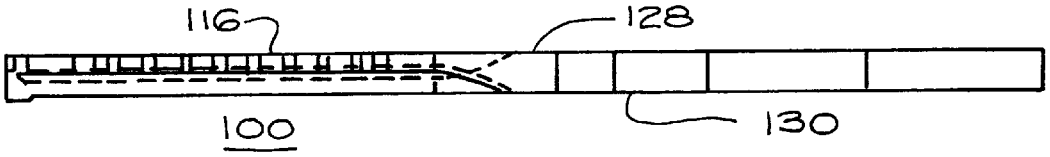
FIG. 17 is a view of one edge of the key of FIG. 16.
Figure 18:
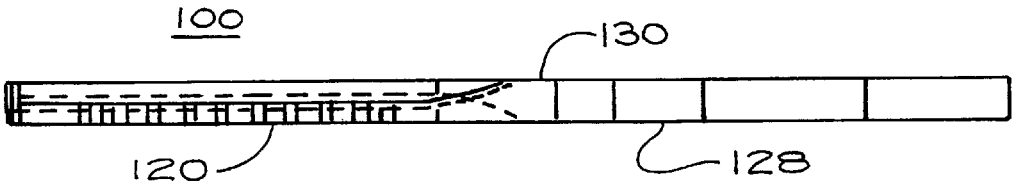
FIG. 18 is a view of the opposite edge of the key of FIG. 16.
Figure 19:
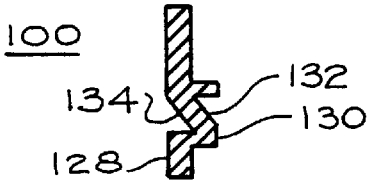
FIG. 19 is a vertical profile section view of the key taken along the line 19—19 of FIG. 16.

Different notch depths in the reversible key 10 can be accommodated by shifting the stagger in the tumbler windows 62 and 63 opening. For example, whereas the tumbler 60 is shown in FIG. 14 to have cam surfaces 71–74 disposed relative to a centerline 76 of the tumbler 60, the tumbler 80 shown in FIG. 15 has cam surfaces 81–84 disposed closer to the centerline 85 with equal and opposite disposition. The invention can use the same number of notches and notch depths as a traditional key design.

While in a highly preferred embodiment, the tumblers are shown as being flat, plate tumblers which are generally rectangular in shape, the key can be used with any suitable tumbler configuration, such as tumblers having a window through the body of the tumbler or tumblers of other geometric shapes or other configurations.

FIGS. 16–19 show a further embodiment for a dual cam, reversible key 100 provided by the invention. The key 100 is similar to key 10 in that the shank 114 of the key has a first pattern of notches 116 formed in one edge 118 of the shank and a second pattern of notches 120 formed in the opposite edge 122. The first and second sets or patterns of notches 116 and 120 define first and second sets of tumbler engaging surfaces 124 and 126. In accordance with the invention, the first and second sets of tumbler engaging surfaces 124 and 126 are provided on the same side 128 of the shank 114 of the key. The tumbler engaging surfaces provide a dual cam function for activating lock tumblers both up and down, somewhat in the manner of a side-milled key. In addition, the first pattern of notches is complementary to the second pattern of notches. The pattern of the surfaces 124 and 126 are substantially identical.

The key 100 has a different end profile that results from milling grooves into opposite sides of the key 100 which function as guide grooves in the manner of the T-shaped and the guide grooves for the key 10. A first groove 132 is formed in side 130 and a second groove 134 is formed in side 128. The result is that the shank 114 of the key has a generally Z-shaped configuration shown in FIG. 19, for example. The key 100 can be used with the lock 56 with modification as to the guide members which cooperate with the guide grooves 132 and 134. Moreover, the key can have other shapes with symmetrically opposed guide grooves.

A generally traditional sequence can be used in the manufacture of the dual cam, reversible keys provided by the invention. The conventional steps of the method include providing a key blank, and forming guidance surfaces in the sides of the key blank in a suitable manner, such as by milling the key blank to form the grooves. To produce the key 10 in accordance with one preferred embodiment, two large mill cuts 34 and 36 are formed in one of the flat surfaces 30 of the key, illustrated in FIGS. 1–6, for example, defining recesses 34 and 36 which provide the key with the shallow T-shaped configuration as viewed from the one end of the key. Then, a pair of smaller grooves 38 and 40 are milled in the other flat surface 28 of the key, the side of the key in which the two patterns of notches will be formed. Then, the key blank is notched on the two opposite edges of the shank to form the coding for the key. The first pattern of notches 16 is formed on one edge 18 of one side 28 of the shank of the key. Then, the second pattern of notches 20 is formed on the opposite edge 22 of the same side 28 of the shank of the key. The second pattern of notches 20 is formed such that the width "w" (FIG. 8) of the side of the shank is constant along the length "L" of the key blade on which the pattern of notches is formed.

The process for forming the key 100 can be similar to the process for forming the key 10 except that the offset grooves 132 and 134 are formed to produce the Z-shaped cross-section for the key 100. The patterns of notches 116 and 120 can be formed in the manner used in producing the key 10.

The size and shape of the dual cam, reversible key does not adversely affect the envelope size of the lock, and the key provides the reversibility feature of existing lock and key sets. In addition, while the invention is described with reference to a key blank having a specific shape and size, blade-type key blanks of any other shape and size can be used.

While preferred embodiments have been illustrated and described, it should be understood that changes and modifications can be made thereto without departing from the invention in its broadest aspects. Various features of the invention are defined in the following claims.

We claim:

1. A dual cam, reversible key for use with a companion lock, said key comprising:

a head portion;

a shank coupled to the head portion, the shank having a first side, a second side, and first and second edges;

the first side of the shank including a first projecting portion which extends longitudinally along the key shank on the first side of the shank, and the second side of the shank including a second projecting portion which extends longitudinally along the shank on the second side of the shank, the width of the first and second projecting portions between the first and second edges of the shank being substantially the same to allow the key to be inserted into the companion lock in first and second orientations;

the shank including notches in the first and second edges on the first side thereof, the notches being located on the same side of a centerline of the key shank and extending along a longitudinal axis of the key, the notches in the shank defining first and second sets of tumbler engaging cam surfaces on the first side of the shank; and the shank having a substantially constant width over at least the portion of the shank which includes the notches.

2. The key according to claim 1, wherein the notches in the first and second edges are of complementary symmetry.

3. The key according to claim 1, wherein the contour of the first edge is substantially the same as the contour of the second edge.

4. The key according to claim 1, wherein the first side of the shank includes first and second guide grooves extending in parallel spaced relation, defining the first projecting portion.

5. The key according to claim 1, wherein the second side of the shank includes first and second recessed regions which extend inwardly from the first and second edges of the shank, defining the second projecting portion.

6. A dual cam, reversible key comprising:

a head portion;

a shank coupled to the head portion, the shank having first and second generally planar sides;

the first side of the shank including first and second patterns of notches in at least a portion thereof, the first and second patterns of notches extending generally parallel to a longitudinal axis of the key, and the first and second patterns of notches being substantially equal in length along said portion of the shank;

first and second guide grooves in the first side between first and second edges, the first and second guide grooves extending in a parallel spaced relation along the shank, defining a first projecting portion extending longitudinally along the first side of the shank, the first longitudinal projecting portion having an outer surface; and the second side of the shank including first and second recessed portions, defining a second projecting portion extending longitudinally along the shank, the second longitudinal projecting portion including an outer surface and first and second side surfaces, the first recessed portion extending inwardly from the first edge of the shank to the first side surface and the second recessed portion extending inwardly from the second edge of the shank to the second side surface.

7. The key according to claim 6, wherein the shank has a constant width over at least the portion of the shank which includes the first and second patterns of notches.

8. The key according to claim 6, wherein the first and second patterns of notches define first and second cam engaging surfaces on said first side of the shank.

9. A dual cam, reversible key comprising:

a head portion;

a shank coupled to the head portion, the shank having first and second generally planar sides;

the first side of the shank including first and second patterns of notches in at least a portion thereof, the notches in the shank defining first and second sets of tumbler engaging cam surfaces on the first side of the shank, the first and second patterns of notches extending generally parallel to a longitudinal axis of the key and being located on one side of a centerline of the key shank, and the first and second patterns of notches being substantially equal in length along said portion of the shank;

a first projecting portion extending longitudinally along the shank on the first side of the shank; and a second projecting portion extending longitudinally along the shank on the second side of the shank, the second longitudinal projecting portion including an outer surface and first and second side surfaces, the width of the first and second projecting portions between first and second edges of the shank being substantially the same.

10. The key according to claim 9, wherein the first longitudinal projecting portion is defined by first and second guide grooves in the first side between the first and second edges, the first and second guide grooves extending in a parallel spaced relation substantially the length of the shank, and wherein the second longitudinal projecting portion is defined by first and second recessed portions on the second side, the first recessed portion extending inwardly from the first edge of the shank to said first side surface of the second projecting portion, and the second recessed portion extending inwardly from the second edge of the shank to the second side surface of the second projecting portion.

* * * * *

UNITED STATES PATENT AND TRADEMARK OFFICE

CERTIFICATE OF CORRECTION

Patent No: 6,101,855

Issued: August 15, 2000

Inventor(s): Steven J. Dimig and Keith D. Zirtzlaff

It is certified that error appears in the above-identified patent and that said Letters Patent is hereby corrected as shown below:

Col. 1, Line 64: "is" should be inserted after "of the invention";

Col. 4, Line 35: after "45", the quotation mark should be deleted;

Col. 5, Line 2: "52*b*" should be "51*b*";

Col. 5, Line 2: "52*c*" should be "51*c*";

Col. 6, Line 18: after "180°", the "C." should be deleted

Signed and Sealed this

Seventeenth Day of April, 2001

*Attest:*

Nicholas P. Godici

NICHOLAS P. GODICI

*Attesting Officer*

*Acting Director of the United States Patent and Trademark Office*